US005224266A

United States Patent [19]

Gratt

[11] Patent Number: 5,224,266

[45] Date of Patent: Jul. 6, 1993

[54] METHOD OF MANUFACTURING A HYDRAULIC PUMP CYLINDER

[76] Inventor: Stanley H. Gratt, 5227 W. 92nd St., Oak Lawn, Ill. 60453

[21] Appl. No.: 718,948

[22] Filed: Jun. 21, 1991

[51] Int. Cl.[5] ..... B22D 19/00

[52] U.S. Cl. ..... 29/888.061; 29/888.048; 29/458

[58] Field of Search ..... 29/888.061, 888.048, 29/527.2, 458; 123/193 L; 425/469; 92/170.1

[56] References Cited

U.S. PATENT DOCUMENTS

| | | | |
|---|---|---|---|
| 1,420,551 | 6/1922 | Ivins et al. | 29/888.061 |
| 1,768,451 | 6/1930 | Hume . | |
| 1,856,272 | 5/1932 | Summers | 29/888.048 |
| 2,414,931 | 1/1947 | Colwell et al. | 29/888.061 |
| 2,455,457 | 12/1948 | Whitfield et al. | 29/888.061 |
| 2,817,562 | 12/1957 | Fleming et al. | 29/888.048 |
| 3,307,996 | 3/1967 | Keneipp . | |
| 3,779,805 | 12/1973 | Alsberg . | |
| 3,903,951 | 9/1975 | Kaneko et al. | 29/888.061 |
| 4,256,445 | 3/1981 | Pingree . | |
| 4,389,921 | 6/1983 | Bush . | |
| 4,395,442 | 7/1983 | Meise et al. | 29/888.061 |
| 4,694,813 | 9/1987 | Mielke | 29/888.048 |
| 4,997,024 | 3/1991 | Cole et al. | 29/888.048 |

FOREIGN PATENT DOCUMENTS

| | | | |
|---|---|---|---|
| 649027 | 9/1962 | Canada | 29/888.061 |
| 0376117 | 7/1932 | United Kingdom | 29/888.061 |

OTHER PUBLICATIONS

"Coatings that Cut Friction", Mach. Design Oct. 21, 1976, vol. 48, No. 24.

*Primary Examiner*—Irene Cuda

*Attorney, Agent, or Firm*—Welsh & Katz, Ltd.

[57] ABSTRACT

A method of manufacturing a hydraulic pump cylinder for use in a hydraulic system having a hydraulic fluid input, a pump for pumping hydraulic fluid to create and maintain a sufficient fluid pressure in the system and a piston. The method includes the steps of selecting a tube of a predetermined length, width and material. The tube has an outer surface and an inner diameter surface which defines a bore axially through the length of the tube. The tube is treated with at least one layer of a liquid lubricant solution comprising a solvent, binder and solid lubricant in selected amounts. The liquid lubricant solution is and after being applied to the tube until it hardens to a sufficiently workable state. Finally, the coating of the cured liquid lubricant solution is machined to form a lubricious, non-corrosive finish of a predetermined smoothness and roundness for use in commercial and non-commercial hydraulic systems.

14 Claims, 3 Drawing Sheets

METHOD OF MANUFACTURING A HYDRAULIC PUMP CYLINDER

The present invention relates generally to hydraulic cylinders, and more specifically to a method of making a hydraulic cylinder, which is inherently lubricious, non-corrosive and capable of utilizing inexpensive and safe fluids such as ordinary tap water with economical, low pressure pumps to obtain high levels of hydraulic force for use in a variety of commercial and non-commercial settings.

BACKGROUND OF THE INVENTION

Hydraulic power systems have generally been limited to industrial and commercial uses because of the high cost of hydraulic cylinders and pumps, the cost of operating and maintaining such systems, the potential for leakage of the hydraulic fluids and the environmental and safety concerns. Although hydraulic systems, such as hydraulic presses, for lifting, pushing or performing other tasks have been used extensively in commercial settings, the true potential of hydraulics has been restricted because of these problems and other limitations associated with the current systems.

Traditionally hydraulic cylinders have been made from metal tubing having relatively thick walls and extremely round, smooth bores. The thickness is needed to withstand the hydraulic pressure generated by the pressurized hydraulic fluid and to prevent the cylinder from excessive expansion under the hydraulic pressure. The bores must be extremely smooth and round to minimize friction and facilitate the movement of the piston relative to the inner wall of the cylinder and to minimize leakage. The required thickness of the cylinder and the cost and time involved in machining a metal bore with the requisite precision combine to make presently available hydraulic cylinders too expensive for use in many settings. The high cost of current hydraulic systems is also attributable to the type of pump and fluid which is dictated by the characteristics of metal cylinders.

The hydraulic force of a given hydraulic system is generally the product of the area of the inside diameter of the cylinder and the pressure of the fluid used to raise the piston to accomplish the intended task. Therefore, an equivalent amount of force can be generated by using a cylinder with a large diameter and low fluid pressure or a cylinder with a smaller diameter and a high fluid pressure.

However, because currently available hydraulic cylinders are so expensive, it has typically been preferable to provide a high fluid pressure with a cylinder of a small diameter. Unfortunately, the savings made in using smaller metal cylinders is off-set by the high costs of high pressure fluid pumps. There are also serious safety problems that result when such highly pressurized fluid escapes through a rupture or leak in the system. Because of increasing energy costs, the cost of running these high powered pumps has become another factor limiting the potential uses of hydraulic systems. Furthermore, to minimize the corrosion of metal cylinders used in current hydraulic systems, the hydraulic fluid used is typically an expensive and messy petroleum-based liquid. Thus, Not only are such fluids difficult to maintain and dispose of, but they are also a safety hazard since they can easily ignite.

Thus, for economic reasons, as well as other considerations, typical hydraulic systems employ small cylinders with extremely strong fluid pumps which use expensive, hydraulic fluids to attain the required amount of force to accomplish a given task. In short, the high cost of hydraulic cylinders coupled with the high cost of high pressure pumps and fluid to obtain the required amount of force to perform a given task have resulted in limited applications of an otherwise remarkably adaptable system that could have an endless number of viable applications.

SUMMARY OF THE INVENTION

Accordingly, among the other objects of the present invention is a method of making a low cost hydraulic cylinder for use in commercial and non-commercial applications, which is inexpensive to machine and which can be used with economical, low pressure fluid pumps to attain necessary amounts of force.

Another object of the present invention is a method of making low cost hydraulic cylinders of large diameters which can employ inexpensive, low pressure fluid pumps with inexpensive and safe, non-toxic fluids to attain large amounts of force required to perform commercial and noncommercial tasks.

Yet, another object of the present invention is a method of making low cost hydraulic cylinders which use large diameter cylinders made from economical material such as polyvinyl chloride (PVC), concrete or other materials that are generally considered as unsuitable materials for hydraulic cylinders.

Yet another object of the present invention is a method of making an apparatus having a low cost hydraulic cylinder of large diameter capable of being used with low pressure fluid pumps, is expandable under pressure, is easy to implement or adapt for use in performing tasks in commercial, non-commercial and household settings, and which has a bore that is economically formed to a round, smooth finish.

In accordance with the present invention, these objectives, as well as others not herein specifically identified, are achieved generally by the present method of manufacturing and apparatus for a low cost hydraulic cylinder. First, tubing of a predetermined length and diameter is selected. Second, the inside diameter of the selected tubing, or cylinder, is then dipped or otherwise coated with a lubricating solution containing a solvent, binder and solid lubricant. The coated cylinder is then cured, forming a solid lubricant film of a desired thickness and covering at least the inside diameter of the tubing. Following the application stage, the coated cylinder can then be shaped or machined to the required smoothness and roundness, while retaining an inherently lubricious finish. Once the hydraulic cylinder of the present invention is completed, a piston can be engaged within the cylinder and adapted for use in a hydraulic system such as a hydraulic press.

Additional advantages and features of the present invention will become apparent from the following detailed description and claims when viewed in connection with the accompanying drawings in which:

DETAILED DESCRIPTION OF THE INVENTION

Figure 1A:
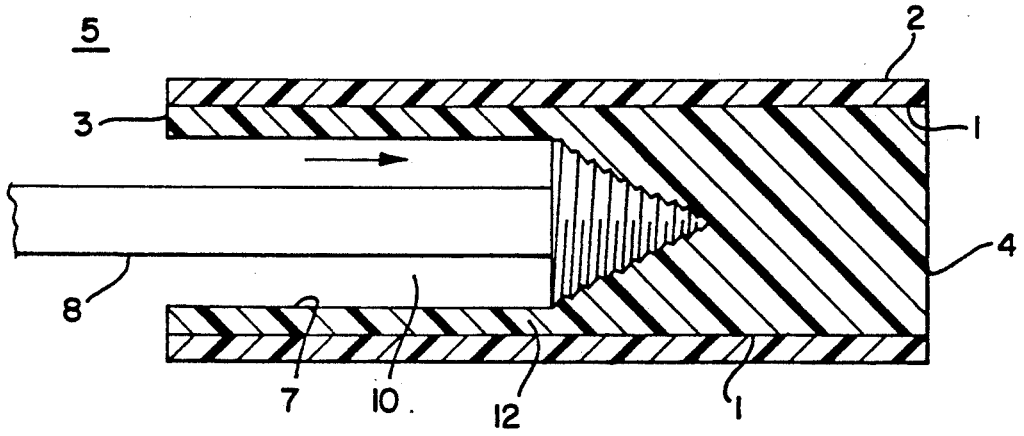
FIGS. 1*a* and FIG. 1*b* depicts a cross-sectional view of the pump cylinder formed by the method of the present invention.

Referring more particularly to the drawings, in FIG. 1, the pump cylinder of the present invention, generally referred to as the cylinder 5, is shown having inner diameter walls, or an inner surface 1, and an outer wall, outer surface or circumference 2, and two ends 3 and 4 diametrically opposed to each other. As illustrated in FIG. 1, the inner surface 1, of the cylinder 5 has been treated with a liquid lubricant solution so that it coats the walls of the inner surface 1 to a desired thickness. The liquid lubricant has been cured and is shown as a layer of solid lubricant 12, covering at least the inside surface 1 of the cylinder 5. The solid lubricant layer 12 can be machined to an extremely smooth and round finish 7, which is non-corrosive, inherently lubricious and over which a piston can ride with minimal friction and wear.

The cylinder is made of a polyvinyl chloride (PVC), polyethylene, or other similar types of low cost synthetic tubing. Alternatively, the selected tubing may be made of other low cost materials such as portland cement or portland-pozzolan cement, or other materials which have to date been considered too rough or porous for use in hydraulic systems. Because the tubing will be relatively inexpensive and can be used in conjunction with inexpensive, low pressure pumps, it is contemplated that the cylinders can be relatively large in diameter to attain the required high levels of hydraulic force necessary to perform certain tasks.

Figure 1B:
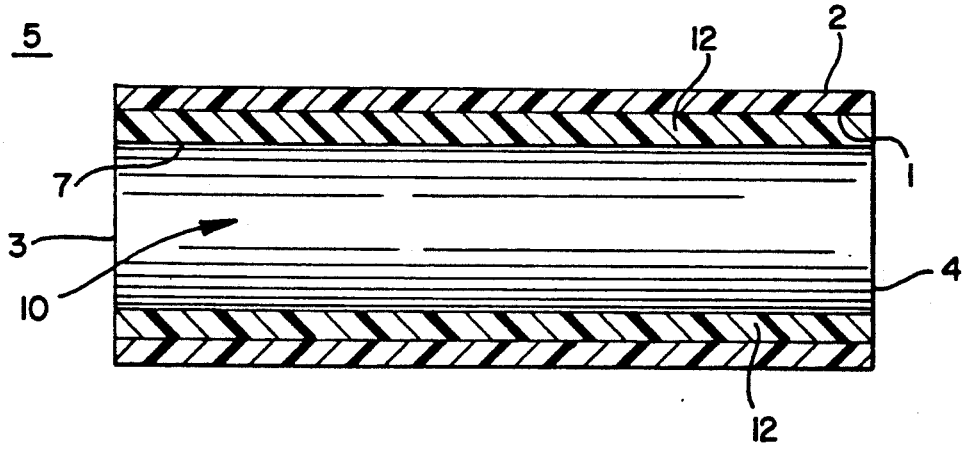
Figure 2:
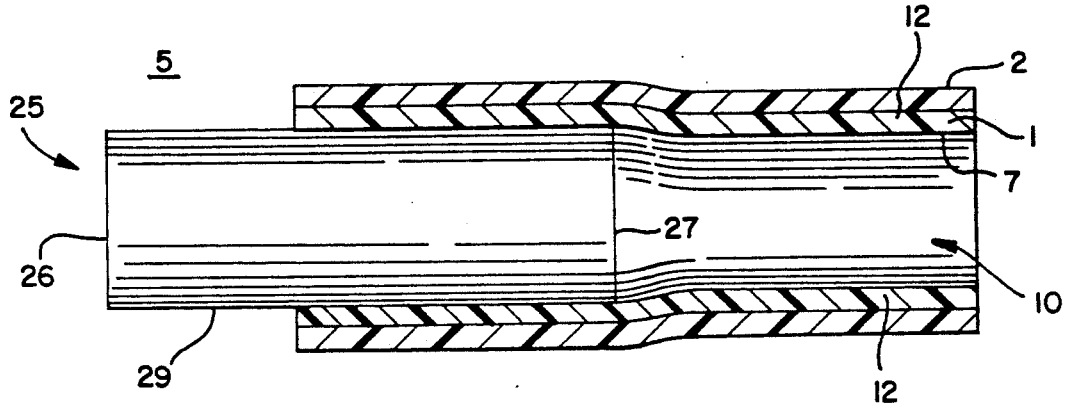
FIG. 2 depicts a cross-sectional view of the pump cylinder which has been coated and machined according to the present invention.
Figure 3:
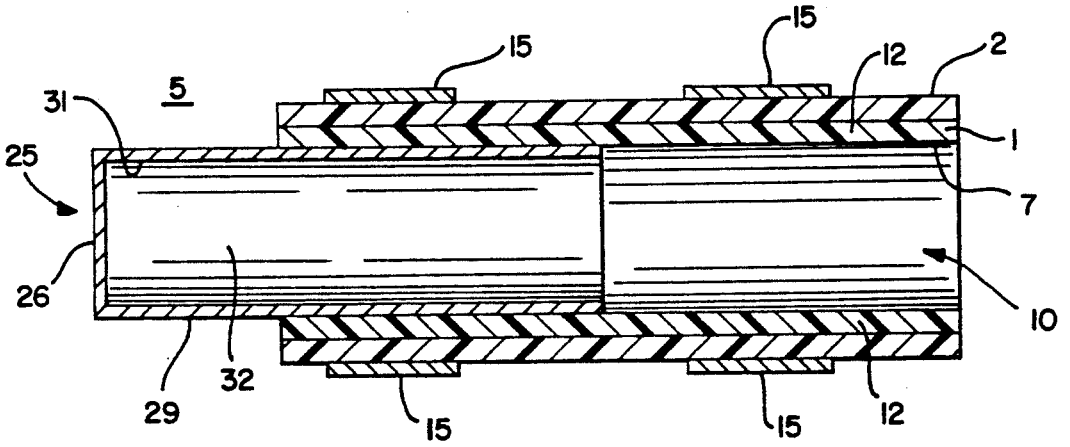
FIG. 3 depicts a cross-sectional view of the pump cylinder of the subject invention where pressurized fluid within the cylinder has caused the cylinder to expand to the circumference of the piston.

The pump cylinder 5, as depicted in FIG. 1-3, is manufactured through a series of inexpensive and uncomplicated steps. In the preferred embodiment, the intended end product is a hydraulic pump tube or cylinder 5, having an inner diameter, or bore 10, which has a hardened layer, or layers 12, of a lubricant substance containing solid lubricating particles. The bore 10, once treated with the lubricant in a liquid form and cured to a hardened film, or lubricious inner finish 7, will be a surface with a relatively low coefficient of friction and over which a piston can ride smoothly.

It is contemplated that the liquid lubricant will comprise any of the commercially available lubricants that can form a hardened film once cured. It should be understood that the following discussion of the liquid lubricants is intended only to illustrate some of the many compositions which the lubricating liquid may comprise, and is not in any way intended to limit the scope of the invention. The layer liquid lubricant coating 12 is generally a solution which includes a solid lubricating material in suspension or in a solution such as Polytetrafluoroethylene (PTFE), molybdenum disulfide, graphite, polyethylene wax, and soft metals, such as lead and tungsten, or any other similar solid lubricant, or combinations thereof. Although not limited to any of these lubricants, others which are commonly known are: Lubri-Bond TM A, 220, 320, 331, manufactured by EM TM Corporation; Calcium Fluoride, Cobalt Oxide, Boron Oxide, Boron Dioxide, Barium Oxide.

The solid lubricant selected is then combined with the appropriate amount of solvent; typically the type and amount will be that recommended by the manufacturer of the solid lubricant, such as methyl ethyl ketone, acetone, or other similar solvents commonly used as a carrier for solid lubricants. The lubricating substance is then mixed to the appropriate amount of varnish, resin, liquid or solid hydrocarbon binder, co-functioning binder, or combinations thereof. Other such solid lubricants and hardening liquid lubricant formulas can be found described in detail in publications of the National Aeronautics and Space Administration. As previously noted, all that is required is that the liquid lubricant substance used be of the type which hardens to a solid, lubricious finish when cured. Accordingly, the method of making the present hydraulic cylinder is not altered by the type of liquid lubricant used to form the hardened lubricating film.

Once the liquid lubricant has been formulated, the selected tubing or cylinder 5, is coated, treated or dipped into a bath consisting of the liquid lubricant substance. The cylinder 5 can also be coated or treated only on its inner surface 1 with the liquid lubricant. Although the method of dipping the entire cylinder in the solution can be wasteful, since the outer surface 2 of the cylinder also receives a coating of the liquid lubricant, it may be desirable to do so because of overall cost savings or to obtain a cylinder having a lubricated outer surface required for certain applications. Nevertheless, it is contemplated that for the majority of applications the cylinder 5 will be coated only on its inner surface 1. This method of coating the inner portions of the cylinder can be accomplished by using mechanical or manual painting, paint spraying or other techniques for applying solidifying liquids.

Once applied to the tubing, the liquid lubricant solution is allowed to harden or cure to a sufficiently workable state. A sufficiently workable state is such that the liquid lubricant is in a fully cured or semi-cured state which can be machined or shaped. To keep costs at a minimum, it is preferred that the curing process take a short time and not involve any complicated additional steps. The curing step can be accomplished by simply letting the liquid lubricant film dry over time. However, because the curing process can be different for each type of liquid lubricant formula used, it is contemplated that other forms of curing may entail the application of heat or other known methods of curing.

Once in a sufficiently workable state, the liquid lubricant layer, or layers 12 of the coating will harden to form a solid lubricant film 7 covering the inner surface 1, which must then be shaped or machined, such as by traditional machining, to a predetermined roundness and smoothness. Thus, the next step in the method requires that the coated inner surface 1 of the cylinder 5 be processed to attain the predetermined surface characteristics needed for a specific hydraulic system. It is contemplated that certain applications may require insignificant, if any, amounts of machining to achieve the desired surface traits. The machining stage of the invention may incorporate commonly used techniques such as boring, broaching, lathing, proaching, planing, milling or the like. Although, the present pump cylinder may require machining in order to attain a finish having the necessary smoothness and roundness, it will be much more efficient and inexpensive to accomplish in comparison with the machining required of a metal surface. More importantly, whether or not the coated layer 12 is machined, the cylinder 5 will have a non-corrosive and inherently lubricious finish covering its inner surface 1.

It should be understood that the specific task that a hydraulic system employing the pump cylinder of the present invention will dictate the amount of lubricating film required and the variability of the film thickness through the length of the cylinder. Accordingly, in addition to the method described above, it is contemplated that the inherently lubricious and noncorrosive hydraulic cylinder of the present invention can be made by first filling the inner diameter 10 of the cylinder 5 with the liquid lubricating substance, allowing the lubricating substance to cure to a sufficiently workable state, thereby forming a core, which can then be punched out, drilled, or otherwise formed into a bore 10 of the requisite length and diameter to fit with a specified piston. As illustrated in FIG. 1*a*, the coated inner surface 1 of cylinder 5 is machined using a drill or bore 8. Once completely machined, the resultant cylinder will have bore 10 as it appears in FIG. 1*b*. The bore 10 will have a solid lubricant film 7 and a coated layer 12 on the inner surface 1 of cylinder 5.

Finally, after the application, curing and machining stages, the completed pump cylinder 5 can be fitted with an appropriate piston assembly 25, as illustrated in FIG. 2. The piston assembly 25 will be generally solid and made of the same materials used in constructing the cylinder 5, or any other commonly used materials for pistons. The piston assembly 25 will typically have an outer end 26, a piston-side end 27 and at least an outer surface 29. The outer end 26 will be configured with the particular surface or implement required to accomplish the desired task. It is foreseeable that certain applications may require that the piston assembly 25, as depicted in FIG. 3, be configured to be hollow, or include an inner cavity 32, having an inner surface 31.

Since the cylinder will be made from tubing such as PVC, which expands under pressure, it is foreseeable that the circumference of the piston-side end 27 may have to be larger than the inner diameter 10 of the cylinder 5. Therefore, as illustrated in FIG. 2, the circumference of the piston side-end 27 and the inner diameter 10 of the cylinder 5 will in some instances be forcibly fitted or engaged prior to pressurization of the system. However, because the inner diameter 10 of the cylinder 5 is inherently lubricious and will generally expand under pressure, it will receive a piston having a large circumference relative to the cylinder without any difficulty. It is intended that the larger circumference of the piston will compensate for the expanding properties of typical PVC tubing under fluid pressure, and will further increase the prevention of leakage of the hydraulic fluids. As shown in FIG. 3, once the hydraulic system is actuated, the cylinder 5 is pressurized and its inner diameter 10 will expand to a width relative to the piston-side end 27. Additionally, to insure that the cylinder retains its structure and will not rupture while pressurized, the cylinder 5 may be configured to include belts or harnesses 15 around its circumference, as depicted in FIG. 3. The completed cylinder 5 and fitted piston assembly can then be adapted a typical hydraulic system having hydraulic fluid input means and pumping means.

Figure 4:
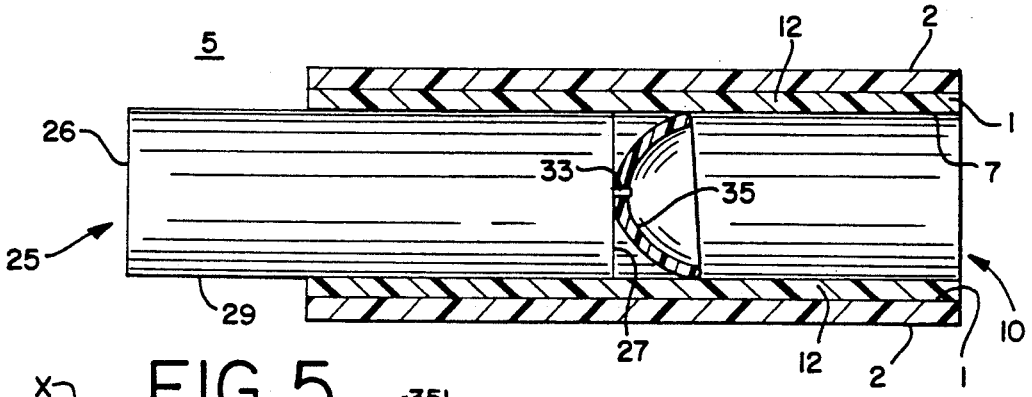
FIG. 4 depicts a cross-sectional view of the pump cylinder showing a piston assembly with a flexible sealing cup affixed to the piston.

Referring to FIG. 4, it should be understood that the hydraulic cylinder of the present invention can incorporate a piston assembly 25, having an expandable cup 35 affixed to the piston-side end 27 of the piston assembly 25, which will be located within the inner diameter 10 of the cylinder 5. The expandable cup 35, will typically be made of plastic, rubber or an other flexible material. The cup 35 is designed to contact the hardened lubricating film 7, so as to form a sealing engagement with the cylinder 5, and which will adjust to the varying widths of the cylinder 5 upon pressurization of the hydraulic system. The cup 35 is removably attached to the end 27 of the piston assembly 25 with conventional fastening means 33.

It is foreseeable that there may be applications of hydraulic systems which require that the hydraulic cylinder have an inner diameter or outer surface having zones or portions that are of different widths and/ or different varieties of lubricating film. Further, it is contemplated that the desired hydraulic cylinder may have multiple layers of the lubricating film, where each layer of the lubricating film will generally be of the same substance. Alternatively, each layer of the coating may comprise different lubricant film substances.

Thus, the method of making the hydraulic cylinder of the present invention may be altered so as to engineer a hydraulic cylinder with zones or portions having different widths and/ or different varieties of lubricating film. It should also be understood that the application of the liquid lubricant and the curing process can be performed repeatedly to obtain a desired thickness of the hardened lubricating film, or to achieve a specified inner diameter, or bore. In other words, the present method of making the hydraulic cylinder can entail repeated or variable applications of the liquid lubricant to arrive at a desired liquid lubricant film thickness.

Figure 6:
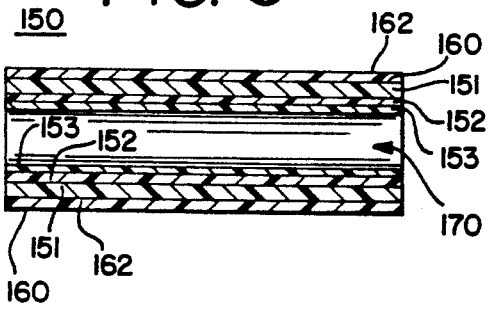
FIG. 6 depicts a cross-sectional view of the pump cylinder having multiple layers of the hardened liquid lubricant.

As shown in FIG. 6, the cylinder having been repeatedly treated and cured, using the above described method, results in a cylinder having multiple layers of hardened film 151, 152, 153 being non-corrosive and inherently lubricious. These layers 151, 152, and 153 cover the inner diameter 160 of the cylinder 150. Cylinder 150 also has an outer surface or circumference 162, which can also be treated with multiple layers of the liquid lubricant to form a lubricating film. Clearly, the specific application of the cylinder will dictate how many layers of the lubricating film are necessary, and whether each of these layers will be of the identical lubricating film composition. Accordingly, it is contemplated that the present method could be utilized to make a hydraulic cylinder where each of the layers 151, 152 and 153 are composed of different hardened liquid lubricant substances and each layer possibly requiring a different type and amount of machining to arrive at a specified finish having the desired roundness and smoothness.

Figure 7:
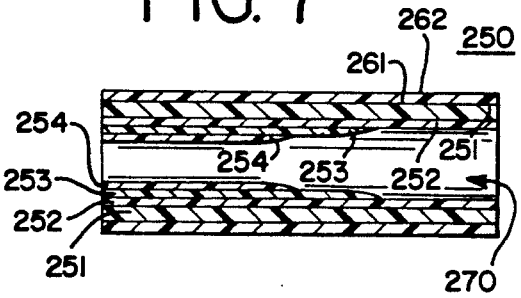
FIG. 7 depicts a cross-sectional view of the pump cylinder having zones of the hardened liquid lubricant.

Further, as depicted in FIG. 7, the method of making the present hydraulic cylinder can be adapted so as to produce a hydraulic cylinder 250 having zones or portions 251, 252, 253, and 254, which are actually plurality of layers of the lubricating film each layer having, if desired, a different width, length, composition or variations thereof. The hydraulic cylinder depicted in FIG. 7, is readily manufactured from the steps involved in the present method heretofore described by altering the method to include the selection of the particular zones of the inner diameter 261 and the outer surface or circumference 262 of the cylinder to be treated. Thus, instead of applying the liquid lubricant coating to the entire cylinder, only predetermined zones or portions of the cylinder are treated and cured, or repeatedly treated and cured with a particular liquid lubricant. It is also contemplated that, although the machining stage is identical to that described above, each of the zones may require a different amount and type of machining to arrive at a specified finish having the required roundness and smoothness.

Figure 5:
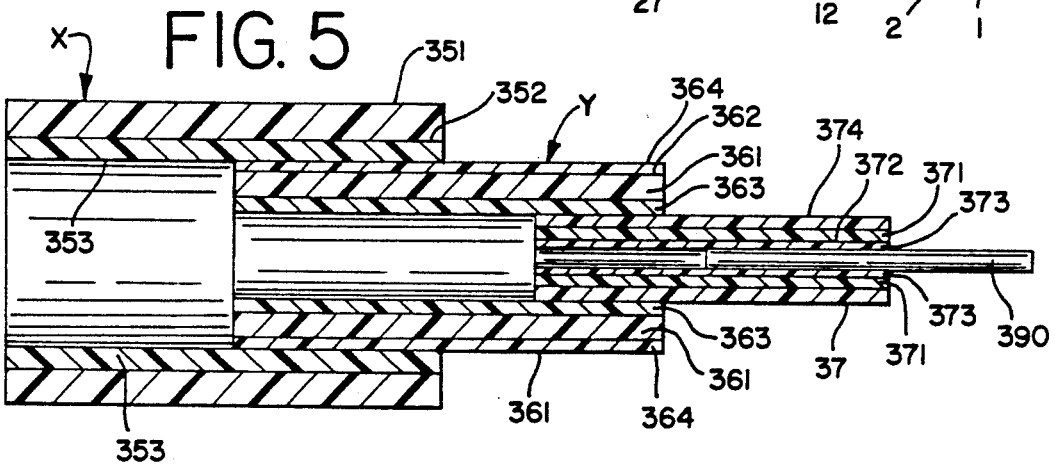
FIG. 5 depicts a cross-sectional view of a telescopic hydraulic cylinder assembly, where each pump cylinder have been formed by the method of the present invention.

As mentioned above, it is anticipated that there will be applications of hydraulic systems which require a hydraulic cylinder that is lubricious and non-corrosive on its outer surface as well as it inner diameter. One such application, depicted in FIG. 5, is a telescopic hydraulic cylinder system. Here the method involves treating the inner diameter walls 352, 362 and 372 of the cylinders X, Y and Z with a layer or layers of the liquid lubricant substance, curing the lubricant substance to form a hardened film and machining or shaping it, if required, to form specified hardened inner lubricated finishes 353, 363 and 373 respectively. In addition, the outer surfaces 361 and 371 of cylinders Y and Z can also be treated with a layer or layers of the liquid lubricant substance, cured and machined if necessary to form the hardened outer lubricating surfaces 364 and 374. The inner and outer lubricated surfaces are thus configured to enable the respective inner cylinder Y or Z to slide within their respective cylinder with a minimal amounts of friction and wear. Similar to the cylinder and piston assembly of FIGS. 1–4, the piston assembly 390 will be fitted into the cylinder Z. The present description involves only three cylinders, but it is contemplated that additional cylinders could be made using the present method to form an even larger telescopic cylinder.

It is contemplated that the method of the present invention will be practiced with tubes having diameters heretofore considered too large and expensive to use if made from traditional metal tubing. Furthermore, the end product of the above-described method, is intended to be a hydraulic tube having a large inner diameter, which is non-corrosive, extremely smooth and round and inherently lubricious. The non-corrosive attributes of the pump tube of the present invention will allow hydraulic systems incorporating the tube to utilize fluids such as ordinary tap water without any extraneous pump, or other fluids which can be used in connection with a low pressure pump and a large diameter cylinder to attain high levels of force. Fluids such as water are cheap to use, can be disposed of efficiently and will obviate the many of the difficulties associated with current systems.

It is foreseeable that the current invention will make the use of hydraulic systems so relatively inexpensive and easily adaptable that it will be applied to an endless number of commercial and non-commercial uses. As an example of such uses, a hydraulic cylinder manufactured using the method herein described will be used in hydraulic press systems such as adjustable boat docks and launches, personal elevators for the multi-level homes, and other lifting or pushing apparatus.

The foregoing specification describes only the preferred embodiment of the invention as shown. Other embodiments besides the one herein shown and described may be articulated as well, the terms and expressions therefore serve only to describe the invention by example only and not to limit the invention. It is expected that others will perceive the differences which, while differing for the foregoing, do not depart from the spirit and scope of the invention herein described and claimed.

What is claimed:

1. A method of manufacturing a hydraulic pump cylinder for use in a hydraulic system having hydraulic fluid input means, pump means for pumping said fluid to create and maintain a sufficient fluid pressure in the system and a piston, the method comprising the steps of:

selecting a conduit of a predetermined length, width and material, said conduit having an outer surface and said conduit also having an inner channel substantially through the length of the conduit;

forming a liquid lubricant solution comprising a solvent, binder and solid lubricant in selected amounts;

substantially filling said channel with said liquid lubricant solution;

curing said liquid lubricant solution until it forms a sufficiently workable core; and machining said core of said cured liquid lubricant solution to form a bore of a predetermined length having an inner surface, said inner surface having a lubricious, non-corrosive finish of a desired smoothness and roundness.

2. The method as defined in claim 1 wherein said channel is filled with a liquid lubricant solution containing a sufficient amount of any one of the following solid lubricants selected from the group consisting of graphite, molybdenum disulfide, polytetrafluoroethylene, boron nitride, polyethylene wax, lead, tungsten, or combinations thereof.

3. The method as defined in claim 1 further comprising the steps of selecting a conduit made of polyvinyl chloride.

4. The method as defined in claim 1 further comprising the step of applying additional layers of said liquid lubricant solution in predetermined amounts to selected portions of said inner channel, curing and machining said additional layers of said liquid lubricant solution.

5. The method as defined in claim 1 further comprising the step of selecting a conduit made of polyethylene.

6. The method as defined in claim 1 further comprising the step of introducing a piston into said bore of said conduit, said piston having an outer surface, an inner surface, an outer end being fully closed and adapted with a head for accomplishing a desired task and a piston-side end which is inserted into said conduit and which is hollow and which is expandable when pressurized fluid is contained therein.

7. The method as defined in claim 6 further comprising the step of:

selecting a piston of plastic material which has a sufficiently small outside diameter such that when the hydraulic system is under pressure said piston-side end of said piston expands in proportion to the expansion of said tube to form a lubricated, sealing engagement between said bore and said piston.

8. The method as defined in claim 7 further comprising the steps of:

coating an outside surface of said piston with a liquid lubricant substance;

allowing said liquid lubricant substance to cure, forming a solid lubricating film on said outside surface of said piston; and machining the coated piston to produce a non-corrosive and inherently lubricious finish which minimizes the coefficient of friction between said bore of said conduit and said outer surface of said piston.

9. The method as defined in claim 8, further comprising the step coating said outside surface of said piston with a substance comprising a solvent, a binder and a sufficient amount of any one of the following solid lubricants selected from the group consisting of graphite, molybdenum disulfide, polytetrafluoroethylene, boron nitride, polyethylene wax, lead, tungsten or combinations thereof.

10. A method of manufacturing a pump cylinder the method comprising the steps of:

selecting a non-machined tube having an inner channel and outer surface;

substantially filling said tube with a liquid lubricant solution, said liquid lubricant solution having an appropriate amount of solvent, binder and dispersed solid lubricant;

curing said liquid lubricant solution to form a substantially solid core within said tubing; and punching through said core to produce a non-corrosive and inherently lubricious bore having an inner surface with a predetermined smoothness and roundness.

11. The method defined in claim 10 further comprising the steps of:

treating said outer surface of said tube with said liquid lubricant solution;

curing said treated outer surface of said tube to form a solid lubricant film thereon; and machining said outer diameter of said treated tube to produce a non-corrosive and inherently lubricious finish of a predetermined smoothness and roundness.

12. The method as defined in claim 10 further comprising the step of dipping said tube into a bath of said liquid lubricant solution to further coat only selected portions of said tube.

13. The method as defined in claim 12 further comprising the step of repeatedly dipping, curing and machining selected portions of said tube to form zones, each of said zones being treated with a different lubricant solution and having a different thickness.

14. The method as defined in claim 10 wherein said bore is further machined to increase the smoothness and roundness of said finish.

* * * * *